US007416162B2

(12) United States Patent
Behroozi

(10) Patent No.: US 7,416,162 B2
(45) **Date of Patent: *Aug. 26, 2008**

(54) SYSTEM FOR MOUNTING, ACCESSING, MOVING AND FOLDING AWAY ARTICLES UNDER A DOWNWARDLY FACING SURFACE

(75) Inventor: Ryan H. Behroozi, Brooklyn, NY (US)

(73) Assignee: Beanius, LLC, Brooklyn, NY (US)

( * ) Notice: Subject to any disclaimer, the term of this patent is extended or adjusted under 35 U.S.C. 154(b) by 26 days.

This patent is subject to a terminal disclaimer.

(21) Appl. No.: 11/499,264

(22) Filed: Aug. 4, 2006

(65) Prior Publication Data

US 2006/0278798 A1 Dec. 14, 2006

Related U.S. Application Data

(63) Continuation of application No. 10/981,362, filed on Nov. 4, 2004, now Pat. No. 7,100,882.

(60) Provisional application No. 60/517,941, filed on Nov. 7, 2003.

(51) Int. Cl.
*A47H 1/10* (2006.01)

(52) U.S. Cl. ..... 248/317; 312/245

(58) Field of Classification Search ..... 248/317, 248/674, 694, 499; 312/245, 246, 247, 313
See application file for complete search history.

(56) References Cited

U.S. PATENT DOCUMENTS

| | | | | |
|---|---|---|---|---|
| 1,260,089 | A | | 3/1918 | Stocker |
| 1,345,194 | A | | 6/1920 | Johnson |
| 2,082,672 | A | | 6/1937 | Waugh |
| 2,254,832 | A | | 9/1941 | Weight |
| 2,492,697 | A | | 12/1949 | Higley |
| 2,599,416 | A | | 6/1952 | Saecker |
| 2,839,349 | A | | 6/1958 | Culver |
| 2,865,634 | A | * | 12/1958 | Townsend ..... 473/482 |
| 3,485,544 | A | | 12/1969 | Beckerman |
| 4,184,725 | A | | 1/1980 | Spangler |
| 4,369,948 | A | | 1/1983 | Krauss et al. |
| 4,460,145 | A | | 7/1984 | Ando |
| 4,807,764 | A | | 2/1989 | Bellin |
| 5,131,620 | A | | 7/1992 | Boundy |
| 5,242,219 | A | * | 9/1993 | Tomaka ..... 312/245 |
| 5,244,272 | A | | 9/1993 | Thompson |
| 5,676,440 | A | | 10/1997 | Garber et al. |
| 6,318,567 | B1 | | 11/2001 | Braley |
| 6,341,754 | B1 | | 1/2002 | Melito et al. |
| 2002/0109444 | A1 | | 8/2002 | Webb et al. |

* cited by examiner

*Primary Examiner*—Ramon O Ramirez
(74) *Attorney, Agent, or Firm*—Keusey, Tutunjian & Bitetto, P.C.

(57) ABSTRACT

A system comprising a tram-rail assembly attachable to a downwardly facing surface (e.g., the underside of a cabinet), a movable carriage assembly, locked into, and suspended on the tram-rails, and a clamshell-configured, pull-down easel attached to the underside of the carriage assembly. The system allows the user to mount, move, remove, and store articles such that the articles are inconspicuous or essentially hidden from view under a downwardly-facing surface, and such that pull-down access to said articles can be gained easily by a user and can be adjusted for height, tilt and depth relative to the user and laterally along the entire, continuous facing edge of a downwardly-facing surface and whereby said access orientation adjustments and said manipulations can be executed easily.

14 Claims, 10 Drawing Sheets

SYSTEM FOR MOUNTING, ACCESSING, MOVING AND FOLDING AWAY ARTICLES UNDER A DOWNWARDLY FACING SURFACE

CROSS-REFERENCE TO RELATED APPLICATIONS

This application is a Continuation of U.S. patent application Ser. No. 10/981,362 filed on Nov. 4, 2004, now U.S. Pat. No. 7,100,882, issued on Sep. 5, 2006, which application claims the benefit of Provisional Patent Application Ser. No. 60/517,941 filed Nov. 7, 2003 by the present inventor [and Disclosure Document No. 530057 filed 2003 Apr. 22 also by the present inventor].

BACKGROUND OF THE INVENTION

1. Field of the Invention

This invention relates to articles and systems of articles, primarily appliances and storage/organizing devices, that are designed to mount under downwardly facing surfaces such as, but not limited to, cabinets and shelves, such as those found in kitchens, workshops, offices, hospitals, utility rooms, storage rooms, laundry rooms or industrial/fabrication facilities.

2. Prior Art

Functional, flexible, accessible work and storage area is needed in virtually all home, office, shop and industrial environments. The size of this usable work and storage area can be substantially augmented by firmly and securely mounting articles such as appliances (e.g., can openers, bookholders, flat panel video displays) and organizing/storage vessels (e.g., spice racks, first aid kits, knife drawers, tool boxes) onto downwardly facing surfaces, such as underneath cabinets or shelves.

Prior art that have sought to make use of the space under downwardly facing surfaces (primarily cabinet bottoms) falls into two major categories.

The first category accounts for the majority of prior art where each invention provides functionality for a specialized purpose, such as an under-cabinet bookholder, can opener or spice rack. Those mentioned below are designed to fold up under a cabinet bottom to take up less space when not in use and pull down again when access and use is required. Specific examples of these inventions include: Document Display Shelf Apparatus (U.S. Pat. No. 6,435,634—Webb—Aug. 20, 2003), Book-holder (U.S. Pat. No. 4,460,145—Ando—Jul. 17, 1984), Disappearing Bookholder (U.S. Pat. No. 4,369, 948—Krauss—Jan. 25, 1983), Book-holding Apparatus for Kitchen Type Cabinet (U.S. Pat. No. 4,184,725—Spangler—Jan. 22, 1980), Bookholder (U.S. Pat. No. 2,599,416—Saecker—Jun. 3, 1952), Bookholder for Cabinets (U.S. Pat. No. 2,254,832—Weight—Sep. 2, 1941), Accessory Drawer (U.S. Pat. No. 2,492,697—Higley—Jan. 8, 1947) Hidden Storage Shelf (U.S. Pat. No. 3,485,544—Beckerman—Dec. 23, 1969), Space-saving Undercabinet Spice Jar Drawer (U.S. Pat. No. 5,244,272—Thompson—Sep. 14, 1993), Knife Drawer Unit (U.S. Pat. No. 2,839,349—Culver—Jun. 17, 1958).

These inventions are designed to be mounted in a stationary location and remain in one place fixed under a cabinet and above a work surface. In other words they cannot be moved easily once installed. It follows that these articles also cannot easily be removed for servicing, adjustment and/or cleaning. Virtually all require tools and some requiring partial dismantling to do so. To install them requires planning, careful measurement and the use of tools, including some specialized cutting and fitting.

The methods for mounting and removing these articles are different for each (i.e., they are nonstandard). Many have inherently weak or unstable mountings due to the small footing areas they span or due to their dependence on only a comparatively thin bottom panel of the cabinet for stability.

To install or remove articles, users must expend considerable effort bending and twisting to properly orient themselves and their tools in order to see the article and installation area underneath the downwardly facing surface.

In use (when deployed/pulled-down) many of these prior art are inconveniently oriented with respect to the user and their intended use and lack the adjustability to remedy the situation. In only a few cases do the articles have some limited means to adjust their position for easier use and/or access by the user.

In cases where the articles are designed to fold up under a downwardly facing surface, once adjusted, folded up, then pulled down again, none are designed to return to their previous user-adjusted position. The user must readjust the unit each time for optimum positioning. Also in the case where the articles are designed to fold up under a downwardly facing surface, some have to be swung through a potentially active work area to do so.

Most are designed to have their front surface flush with the facing plain of the cabinet. As such, they are not design to completely disappear under a recessed-bottom cabinet and therefore all are either visually conspicuous or require their outwardly facing components to be matched with existing cabinetry. Aligning and fitting the facing surfaces of these articles with the great variety of cabinet designs, dimensions and specifically, recessed-bottom depths makes installation even more complex.

Items wider than these units themselves cannot be folded up into the units (e.g., a wide book in a narrow bookholder) since such wide items would interfere with the folding mechanisms and/or support framing.

None provide a means for easily (i.e., by hand, without tools) moving and remounting the article along the length of the downwardly facing surface (e.g., a cabinet bottom) and it follows that none of these articles can be moved in this way while in use.

Since each has its own means of permanent mounting, none of these specialized articles are designed to be interchangeable (i.e., swapped) with one and other. Due to their differences in design approach and a lack of common parts, very little manufacturing, development, user training and marketing efficiencies (cost savings) can be realized within these inventions.

A second, smaller group of inventions attempts address the issue of mounting articles under a downwardly facing surface with a standardized approach that can be used for a variety of articles. These inventions have many significant limitations including their instability, lack of a pull-down/fold-up capability, difficult and inflexible installation, significant limitations on lateral positioning of items and their cumbersome and inflexible means of mounting, moving, and removing articles.

These systems also do not employ any common/standard means of power delivery where electric power is required for a specific article (e.g., flat panel video screen).

A System for Mounting Articles Under a Downwardly Facing Surface (U.S. Pat. No. 4,807,764—Bellin—Feb. 28, 1989) employs one or, optionally for heavier objects, two tracks that attach to a downwardly facing surface and provide evenly-spaced cutout slots which can receive standard brackets in which articles can be hung. Each track must be attached via a single line of screws/fasteners to a cabinet bottom thus the strength of the cabinet bottom and the straight-line configuration of the screws limit the strength and (torquing) stability of the system. In the case of recessed bottom cabinets, there is no opportunity to stabilize the track(s) on the cabinet's descending side front or back panels.

The tracks do not expand lengthwise to fit the mounting surface therefore they would have to be cut to size to fit under the cabinet. As such installation requires measuring and cutting or standard lengths of track must be made available to the user. If provided in standard lengths, it is likely these standard lengths would not fully utilize the potential mounting space in most cases.

Also articles can be attached to the track only at discreet intervals as dictated by the cutout slots. The width of the articles installed should also fall loosely within the same discreet intervals to ensure a proper fit within the mounting brackets. Articles also must remain in the same position when not in use and cannot be folded up out of sight and out of the way of a potential work area.

In order to change the position of an article, the article must be dismounted using screwdriver or thumbscrews/wing nuts and remounted in another set of slots. This not only requires a good deal of effort but also in many cases requires that the article be at least partially dismantled and taken out of use to be removed or moved. Height, tilt, protrusion are not adjustable by any means in this system.

An Under-the-cabinet Appliance Having a Unitary Mounting Bracket and Method for Assembling the Same (U.S. Pat. No. 5,676,440—Garber—Oct. 14, 1997) provides a standard under-cabinet bracket for mounting appliances such as can openers and coffee makers. This system requires that the appliances be manufactured to fit the specific bracket design. The bracket is installed using tools in one place under a cabinet and the system makes no provisions for lateral adjustment/moving of appliances along the bottom of the cabinet. There is also no facility for folding the appliance up out of the way when not in use, no standard means of power delivery, and no way for users to adjust the appliances height, tilt and protrusion relative to the cabinet and themselves.

Similarly, Small Appliance Modular Hanger System (U.S. Pat. No. 6,341,754 B1—Melito—Jan. 29, 2002) provides a standard under-cabinet bracket more adjustable and therefore more adaptable to mounting appliances of differing dimensions than the prior example, but the system requires tools to install and adjust an appliance. Once installed the appliance is fixed in one place under a cabinet and the system makes no provisions for lateral adjustment/moving of appliances along the bottom of the cabinet. Again, there is also no facility for folding the appliance up out of the way when not in use, no standard means of power delivery, and adjusting the appliances for height, tilt and protrusion relative to the cabinet requires tools.

SUMMARY OF THE INVENTION

It is the objective of the present invention to create additional functional, flexible and accessible work and storage area in the home, office, workshop, automobile, medical and industrial environments by providing means to firmly and securely mount, store and access articles such as appliances (e.g., flat panel video displays/monitors, can openers, weighing scales) and organizing/storage vessels (e.g., spice racks, first aid kits, sewing boxes, knife blocks, tool kits) on downwardly facing surfaces, such as the underside of cabinets and shelves.

The present invention is a system for mounting, accessing, moving, folding away and powering articles including, but not limited to, appliances and organizing/storage vessels under a downward facing surface (e.g., a shelf or a cabinet). There are three key elements of the system: (A) A tram-rail arrangement, which in its preferred embodiment easily installs on and expands to the length of a downwardly facing surface (e.g., the underside of a cabinet or shelf); (B) a sliding carriage assembly which locks into and is suspended on the tram-rail arrangement and can be moved by hand to any continuous position along the length of the tram-rails. (C) a pull-down easel that attaches to the sliding carriage assembly. This easel has a substantially clamshell-shaped configuration that can hold, with limited modifications, a wide range of substantially flat appliances and storage/organizing vessels. The sliding carriage, without the easel, can also be used to mount articles on the tram-rails that are not flat and/or do not require the easel's pull-down functionality, such as toaster ovens and can openers.

The system's design allows articles such as appliances and storage devices to be mounted, moved, accessed and folded up and out of the way, substantially hidden under a cabinet or shelf with little effort.

No matching to existing cabinet facing materials is necessary as the system allows items to fold away under the cabinet with no part of the system coplanar with the facing plain of the cabinet.

Due to its wide triangular bracing arrangement when deployed and a wider footing base this unit has greater strength and stability than prior art. In the case of recessed bottom cabinets, there is the option to mount the tram-rail assembly by anchoring it to the cabinet's descending side front or back panels instead of, or in addition to, mounting on just the cabinet bottom. This provides additional strength and mounting stability.

The system allows articles to be mounted in such a way that they can be pulled down and adjusted (for height, tilt, forward protrusion) into a position for convenient (ergonomic), stable access and use. A user will be able to preset these preferences and have them duplicated each time the article is pulled down. Furthermore, the system allows the articles to be easily folded away substantially out of sight and out of potential work areas when not being used or accessed. The system allows articles to be folded away in such way that they do not interfere (while being folded) with work areas underneath them that may be in use.

Because of the clamshell-shaped configuration of the easel, items folded up on the fold-down easel can be much wider than the actual easel itself and will not interfere with the folding mechanism. The system in its preferred embodiment will allow the article to stay in its folded-up position without the need for a catch, friction adjusted mechanism or locking device.

The system also allows articles to be easily (i.e., by hand and without the use of tools) mounted anywhere (i.e., continuously) along the length of the downwardly facing surface, swapped interchangeably, moved while in use (e.g., moving a book holder while there is a book on it) and removed for cleaning, adjustment and servicing. Once the tram-rail assembly is installed, the user will be able to perform these mounting moving and removing tasks "blind" (i.e., without having to bend below the level of the downward facing surface and look up to see the mounting apparatus or the article.) In one embodiment the system also provides a reliable, universal means of power delivery to articles that require it.

The clamshell-shaped configuration of the pull-down easel also provides superior protection for the articles it holds. When folded the easel orients the article (e.g., a flat panel video screen) facing upward against the cabinet bottom. The cover-brace further protects the article when folded.

The system is easy to install and requires a minimum of tools and planning and no measurements. In the preferred embodiment the tram-rails are configured to expand to fit the cabinet bottom and are light enough to be stuck onto a cabinet bottom with double sided adhesive tape prior to securing them to the cabinet bottom with as few as six screws.

Manufacturing, development and marketing efficiencies (cost savings) can also be realized because this system and articles used by the system are designed to be interchangeable and share many common parts. Users will find that mounting, detaching, folding-away and accessing different articles will use essentially the same methodology for all applications.

Further objects and advantages of my invention will become apparent from a consideration the drawings that follow and ensuing description.

DRAWINGS—LIST OF REFERENCE NUMERALS

Figure 1:
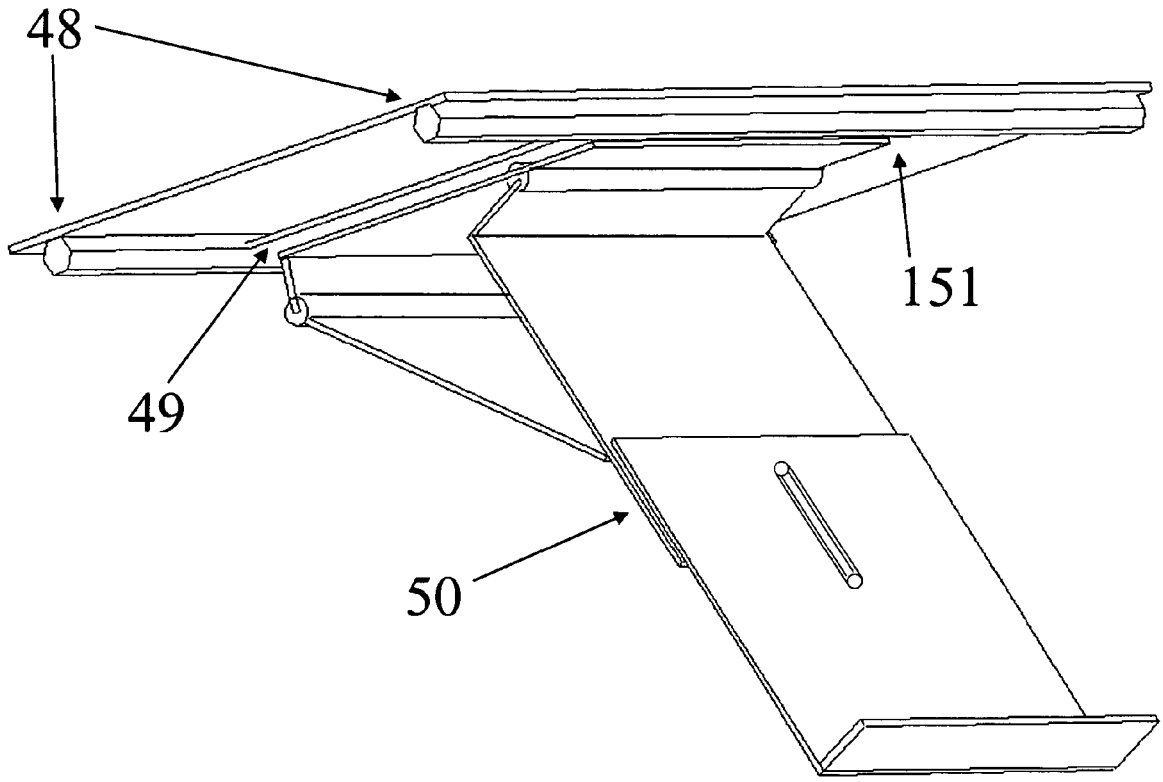
FIG. 1 is a perspective view of a simplified embodiment of the system. Subsequent drawings and comments depict the preferred embodiment.

48 tram-rail assembly
49 sliding carriage assembly
50 pull-down easel
51 rail segment-small
52 rail segment-large
53 rail holes
54 horizontal slots
55B back rail stabilizer clips
55F front rail stabilizer clips
56 stabilizer screws
57 middle rail screws
58 mounting blocks
59 outer rail screws
60 end screws
61 mounting screws
62 spacing plate
63 carriage base platform
64 back engaging plate
65 back carriage footing
66 lock arm
67 lock lift bump
68 lock cutout notch
69 expansion slots
70 slide posts
71 spring anchor point
72 contraction-tensioned spring
73 spring anchor point
74 free edge
75 compression stop edge
76 brake stop
77 sliding lock cam
78 locking edge

79 push point
80 lock cam slot
81 brake cutout notch
82 brake arms
83 brake screws
84 brake lift bump
85 break arm hook
86 front carriage footing
87L locking handle
87R gripping handle
88 lever stop
89 brake return lever
90 compressed spring
91 spring anchor
92 cam guides
93 mounting posts/screws
94 easel base
95 slide pins
96 shallow slide chanl. (R & L)
97 stop slot
98 easel base skirt
99 wing nut
100 stop block
101 easel cap
102 easel shelf
103 base slot
104 hook saddle
105 narrow-channel hook
106 wing nut
107 twist-locking catch post
108 cover-brace
109 closed-tensioned spring
110T top spring pressure pt. 110B bottom spring pressure pt.
111 axel
112 side hinge block (R & L)
113 middle hinge block
114 stop post
115 base slot
116 base channel (R & L)
117 extension slot
118 payload
119 easel shelf extension
120 easel foot
121 power track
151 recessed bottom of a kitchen cabinet (downwardly facing surfc.)
152 descending side panels of cabinet (R & L)
153 descending front panel of cabinet
154 descending back and side panels of cabinet

DETAILED DESCRIPTION OF THE PREFERRED EMBODIMENTS

In this overview of the preferred embodiment in FIG. 1, the three key elements of the system are shown. The tram-rail assembly 48 is fixed to a downwardly facing surface 151 (e.g., the underside of a cabinet) by attachment means that included screws, fasteners and/or adhesives. The sliding carriage assembly 49 is slidably locked into and suspended on the tram-rails allowing the carriage to move anywhere along the length of the rails. The clamshell-configured pull-down easel 50 is attached to the bottom of the sliding carriage assembly. The pull-down easel 50 is shown in its open position. Subsequent drawings depict the preferred embodiment in greater detail.

Tram Rails—Preferred Embodiment

Figure 2:
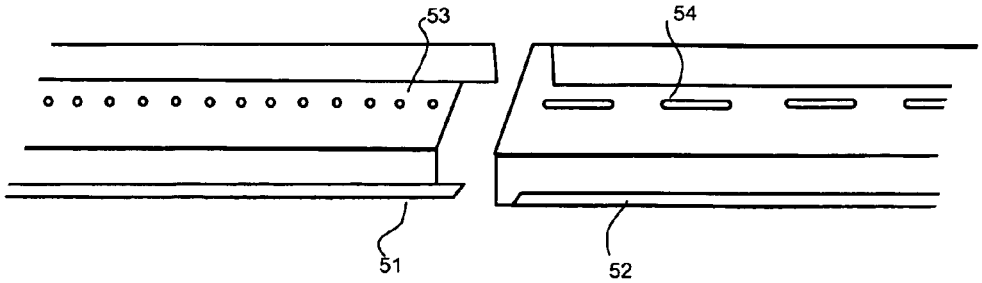
FIG. 2 is a fragmentary perspective view of the two fitted tram rails segments that comprise a single tram rail. The two rail segments (which fit together) are shown separated.

FIG. 2 is a fragmentary perspective view of the two fitted tram rails segments that comprise a single tram rail. The two rail segments, small 51 and large 52 which fit slidably together, are shown here separated. In this preferred embodiment each tram rail segment, 51 and 52, is a straight, concaved, "angular C-shaped" profile (see FIG. 4), rigid member where 51, its circumference being slightly smaller, fits snugly and slides stably within 52 allowing the assembled rail unit to extend and contract horizontally (i.e., lengthwise) to adjust to particular length of downwardly facing surface (see FIG. 3).

The slightly larger rail segment 52 has horizontal slots 54 cut into its back surface. The smaller inside rail 51 has round holes 53 punched into its back surface. These are of consistent size, vertical position and spacing to match up vertically against the slots 54 when the two rail pieces (51 and 52) are fitted together. Places where the holes 53 in rail 51 match up against slots 54 in rail 52 provide receiving aperture through which screws can attach the rails and rail stabilizers 55 to the downwardly facing surface 151 (see FIGS. 5 and 6). This will allow the rails to be attached firmly to the cabinet bottom regardless of the length to which the rails are expanded/contracted.

Tram Rails—Other Embodiments

[Other embodiments of this rail arrangement could assume other concave or convex profile configurations, and be fixed in length or designed to be cut to size, rather than being inherently expandable and contractible.]

Tram Rail Assembly—Preferred Embodiment

Figure 3:
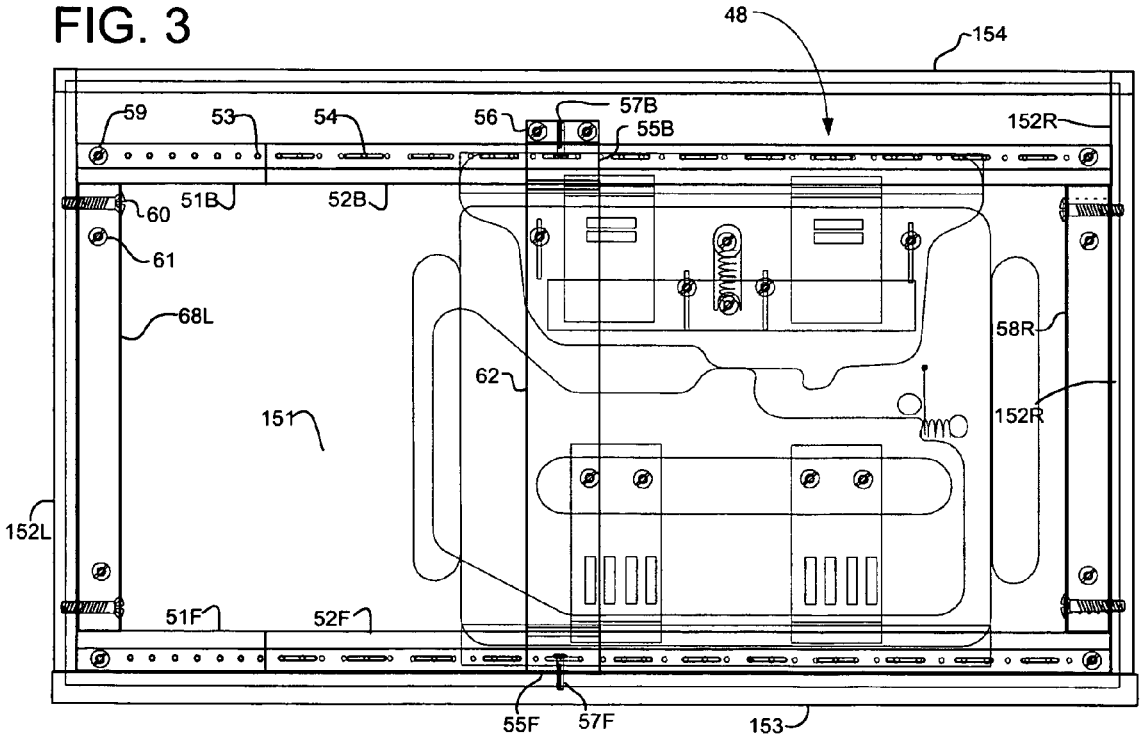
FIG. 3 is a schematic view from below a downwardly facing surface showing the tram-rail assembly which includes tram rails, mounting blocks and rail stabilizers. The tram-rail assembly is attached to the downwardly facing surface, in this case, the underside of a recessed-bottom kitchen cabinet.
Figure 7:
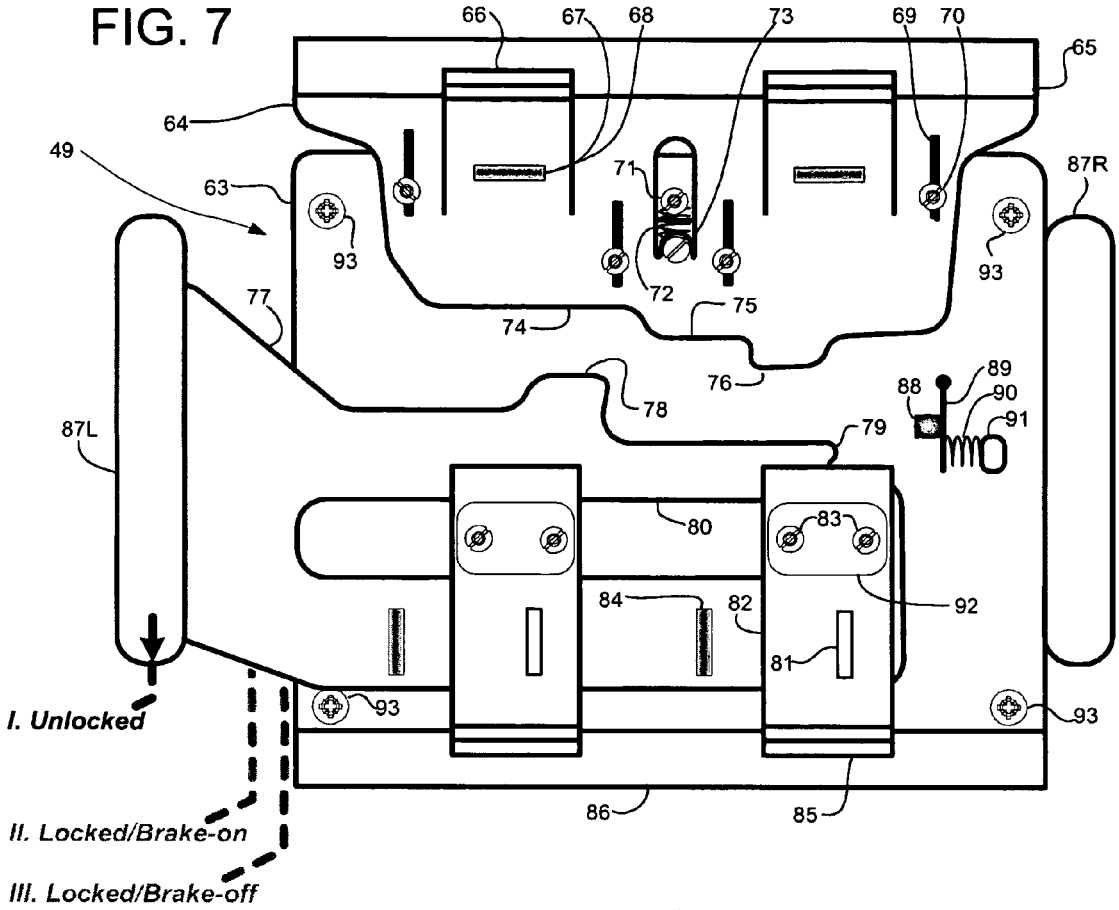
FIG. 7 is a schematic top view of the sliding carriage assembly with its locking handle in the "Unlocked" position (position I).

FIG. 3 is a schematic view from below of the tram-rail assembly 48, which includes front and back tram rails, each consisting of rail segments 51 and 52, mounting blocks 58 and rail stabilizer clips 55. [The carriage assembly, which is detailed in FIG. 7, is represented here with dotted lines to illustrate how it will engage the tram rails.] The tram-rail assembly 48 is attached to the downwardly facing surface, which is, in this case, the recessed bottom of a kitchen cabinet 151. The descending front, back and side panels of the cabinet are shown as 153, 154, 152R and 152L respectively. The tram-rail assembly 48 consists of two sets of horizontally (i.e., lengthwise) expandable/contractible rigid tram rails (51F fitted within 52F and 51B fitted within 52B) where both rail sections, front and back, run parallel to each other and to the front, accessible face of the cabinet and, in this preferred embodiment, act as a forward load-bearing member and a rearward load-bearing member respectively. They are perpendicularly abutted and held in place at both ends by mounting blocks 58L and 58R (see also FIG. 4). The rails are fastened to the mounting blocks 58L and 58R by outer rail screws 59. The mounting blocks are secured to the downwardly facing surface 151 by mounting screws 61 and to the descending side panels 162 of the recessed-bottomed kitchen cabinet by end screws 60. Rail stabilizers 55 attached to the front panel 153 and/or cabinet bottom 151 with middle stabilizer screws 56 and middle rail screws 57 (see also FIG. 5). The rail stabilizers 55 keep the rails from moving and twisting when the rails 51, 52 must span a considerable length. A thin, spacing plate 62 further anchors the rail stabilizers 55 and ensures proper spacing between them.

Figure 4:
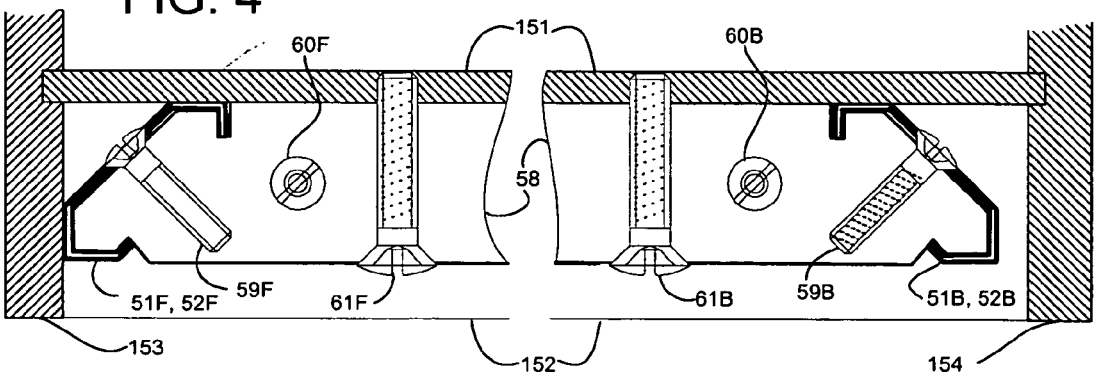
FIG. 4 is a fragmentary schematic side view of a mounting block at the points at which it connects to the tram rails and the cabinet bottom.

FIG. 4 is a fragmentary schematic side view of a mounting block 58 at the points at which it connects to the tram rail 51 or 52 and the cabinet bottom 151. Each end of the mounting block 58 is shaped so that the "C"-shaped concavity of rail 51 or 52 fits snugly onto it. A screw 59 prevents sliding and further stabilizes the rails at the point of attachment to the mounting block 58. The mounting block 58 attaches to the underside of a cabinet by one or both of the following means. A mounting screw 61 attaches the tram-rail assembly directly to the cabinet bottom 151. In the case of a recessed bottom cabinet, an end screw 60 mounts the tram-rail assembly by attaching it to the cabinet's descending side panels 152 (see FIG. 3). Note that the expanding rails allow the mounting blocks 58 to be pushed up against and flatly engaging both cabinet sides 152R & 152L for a wide firm fit.

Figure 5:
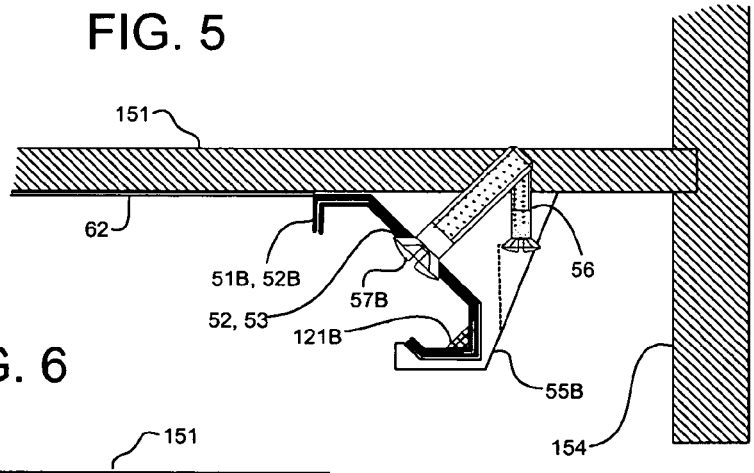
FIG. 5 is a schematic side view of the back rail-stabilizing clip holding the back tram rail.
Figure 6:
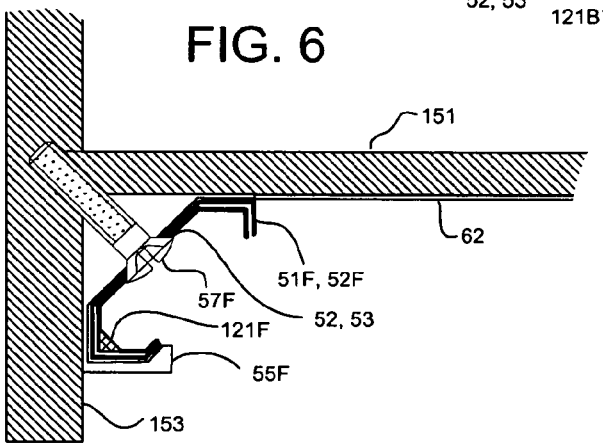
FIG. 6 is a schematic side view of the front rail-stabilizing clip holding the front tram rail.

When the tram rails 51 and 52 are required to span a long length of downwardly facing surface relative to their extended length and nested overlap, additional stability can be achieved by using a front rail stabilizer clip 55F and back rail stabilizer clip 55B. FIG. 5 shows a side schematic view of the back rail stabilizing clip 55B holding the nested tram rail segments 51B and 52B of the back rail. The stabilizer clip 55B is fastened to the cabinet bottom 151 with stabilizer screw 56 and middle rail screw 57B. FIG. 6 shows a side schematic view of the front rail stabilizing clip 55F holding the nested tram rail segments 51F and 52F of the front rail. The clip 55F is fastened to the cabinet bottom 151 and front 153 with a rail screw 57F. The stabilizing clips 55F and 55B are connected by a thin, flat spacing plate 62 that runs along the bottom of the cabinet 151. The combination of end blocks 68 and rail stabilizers 55 and expanding rails allow the tram rails to be easily fitted without measuring, easily secured to the cabinet bottom with as few as six screws and to remain sturdy and in proper position once installed. Rather than use clamps to install the unit, the tram rail assembly 48 in this preferred embodiment is designed to be light enough to temporarily attach to a cabinet bottom with two-sided tape prior to driving screws to permanently install the unit.

Tram Rail Assembly—Other Embodiments

[Other embodiments of this rail arrangement could employ an additional rail or rails for additional strength, stability and/or functionality such at a separate rail to supply electricity. Other embodiments of this system could also include an integrated power track 121 within the front and/or the back tram rail that could include single or dual power track with conductive strips on its face. These conductive strips could carry DC power from a rail-mounted transformer to rail-mounted appliances that require it, or AC power to an appliance with integrated transformer. The power track 121 could be fastened in place with adhesive inside the front tram rail 51F, 52F and/or the back tram rail 51B, 52B as shown.]

Sliding Carriage Assembly—Preferred Embodiment

FIG. 7 is a schematic top view of the sliding carriage assembly 49 with its locking handle 87L in the "Unlocked" position (position I). In this view the sliding carriage assembly 49 is separate from and therefore not engaged in the tram-rails. The carriage base platform 63 provides the structural basis of the sliding carriage assembly 49. The carriage base platform 63 is essentially a flat rectangular panel with its front edge bent obliquely downward forming the front carriage footing 86 (see FIG. 9). The front carriage footing 86 is shaped such that it can snugly engage the front tram rail 52F/51F and, in combination with the back carriage footing 65 (see FIG. 8) engaged in the back rail 52B/51B, carry the weight of the sliding carriage assembly and its attached carriage payload. The spring-loaded back engaging plate 64 is basically a trapezoidal flat panel with its back (wide) edge bent obliquely downward forming the back carriage footing 65 (see FIG. 8). The spring-loaded rear engaging plate 64 is attached slidably to the carriage base platform 63 by slide posts (screws or pegs) 70*a, b, c* & *d* which fit snugly through the expansion slots 69*a, b, c* & *d*. The contraction-tensioned spring 72 fits inside offset, rectangular spring slots cut in both panels 64 and 63 and is anchored to the panels at spring anchor points 71 and 73. The locking arm 66 is also part of the back engaging plate 64. It hooks upward at its end (see FIG. 8) and will engage the top edge of the tram rail when the engaging plate 64 is compressed. The locking handle 87L, shown in position I (Footing-UNLOCKED/Brake-OFF), it is attached to the sliding lock cam 77 which is slidably mounted on the carriage base platform 63. The sliding lock cam 77 has a rectangular lock cam slot 80 cut in it that fits over two flat rectangular cam guides 92 (see FIG. 9). The sliding lock cam 77 is held on the cam guides 92 by the brake arms 82 which are fastened in place using brake screws 83.

Figure 8:
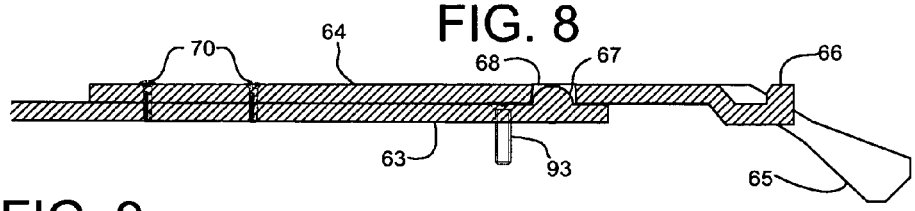
FIG. 8 is a fragmentary schematic side view of the sliding carriage assembly's Rear Tram Footing in its uncompressed, disengaged state.

FIG. 8 is a fragmentary schematic side view of the sliding carriage assembly's rear tram footing in its uncompressed, disengaged state. The rear footing 65 is shaped such that it will fit in the tram rails. With the engaging plate 64 uncompressed the cutout notch 68 on the lock arm 66 locates over the lock lift bump 67 on the carriage base platform 63. Therefore the lock arm 66 is unbent and in line with the carriage base platform 63 and the rest of the engaging plate 64. The carriage payload will be attached to the carriage base platform 63 (either directly or on a pull-down easel) on the four mounting posts/screws 93 at its four corners.

Figure 9:
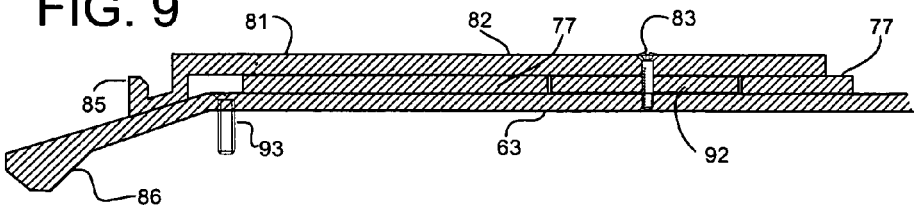
FIG. 9 is a fragmentary schematic side view of the sliding carriage assembly's front carriage footing and brake arm disengaged from the tram-rail.

FIG. 9 is a fragmentary schematic side view of the sliding carriage assembly's front carriage footing 86 and brake arm 85 disengaged from the tram-rail. The lift bump 84 (not shown) on the sliding lock cam 77 is located behind the brake arm 82 (see FIG. 7), therefore the lock arm 82 is unbent and in line with the carriage base platform 63 and the sliding lock cam 77. This view also shows how the sliding lock cam 77 is held in place on a cam guide 92 fastened by screw 83 between the carriage base platform 63 and the break arm 82.

Figure 10:
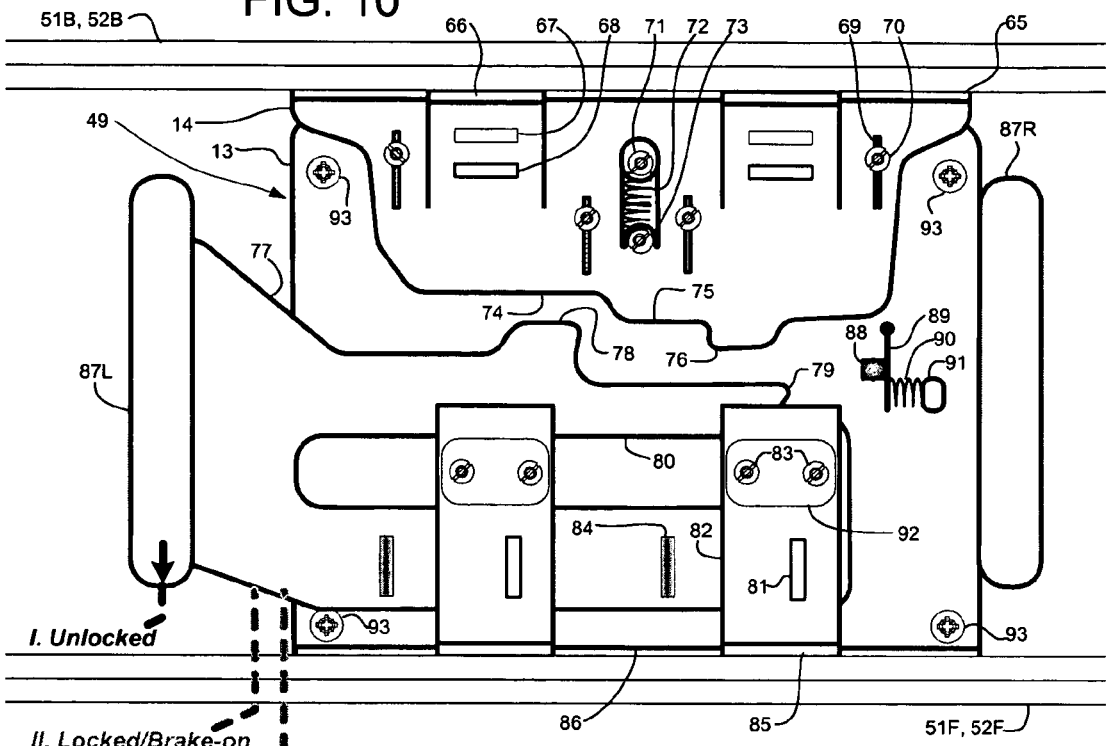
FIG. 10 is a schematic top view of the sliding carriage assembly compressed with its Front and Rear Tram footings engaged in the Tram Rails (dotted lines) and the locking handle still in the Unlocked position (position I).

FIG. 10 is a schematic top view of the sliding carriage assembly compressed with its front and rear tram footings, 86 and 65, engaged in the Tram Rails 51 and 52 (show as dotted lines). Note the locking handle 87L is still in the "Unlocked" position (position I) meaning that the sliding carriage 49 is engaged in the tram rails but not locked. With both footings 65 and 86 aligned respectively in the tram rails 52F, 51F and 52B, 51B, the spring 72 tension pulls the back engaging plate 64 toward the rear causing both footings 65 and 86 to engage the tram rails firmly and reliably. In this unlocked position, the sliding carriage assembly 49 can be removed from the tracks by pushing the two carriage handles 87L & 87R backward (i.e., toward the back rail) and compressing the spring-loaded back engaging plate 64 against the rear rail. Once the carriage is compressed, the front footing 86 can be removed from the front tram rail, the sliding carriage assembly tilted down, and then the rear footing 65 can be removed from the back tram rail.

Figure 11:
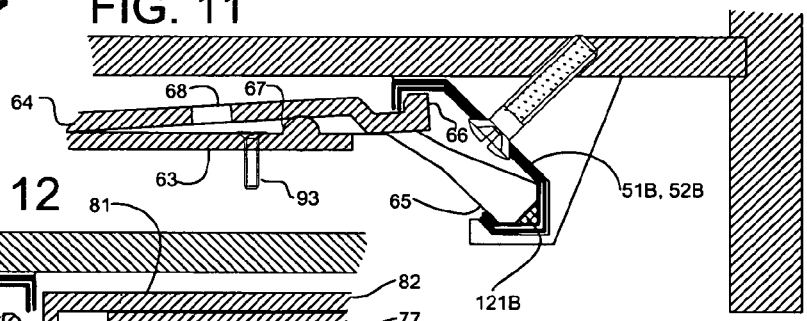
FIG. 11 is a fragmentary schematic side view of the sliding carriage assembly's rear tram footing and lock section in its compressed, tram-rail-engaged state.

FIG. 11 is a fragmentary schematic side view of the sliding carriage assembly's rear tram footing 65 and lock 66 section in its compressed, tram-rail-engaged state. Having been slid back (compressed) in order to fit the sliding carriage assembly between the tram rails, the engaging plate 64 has moved such that its lock cutout notch 68 has slid up and away from the lift bump 67 on carriage base platform 63 thus raising the lock arm 66. Note there is still a small distance between the lock arm 66 and the top tram rail edge 52B, 51B. With the lock arm 66 in this position the sliding carriage assembly is locked in the tram rail but still able to slide laterally. Because of the shape of the tram footing 65, the weight of the carriage and carriage payload and the pressure of the spring 72, the back carriage footing 65 will firmly engage the tram rail. In the case where electricity is need by an article carried on the sliding carriage, a terminal (not shown) in the tram footing 65 would make contact with the back power track 121B and allow power to flow to the article.

Figure 12:
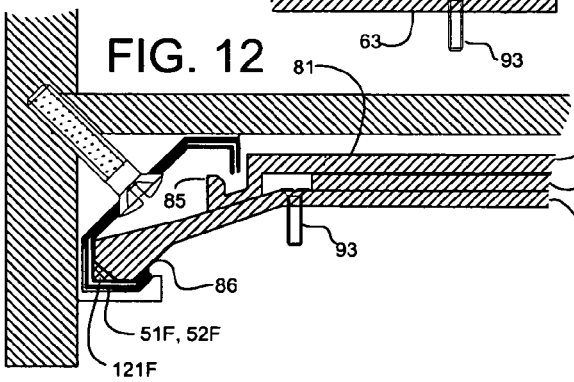
FIG. 12 is a fragmentary schematic side view of the sliding carriage assembly's front carriage footing and brake engaged in the tram rail.

FIG. 12 is a fragmentary schematic side view of the sliding carriage assembly's front carriage footing 86 and brake 85 section engaged in the tram rail 52F, 51F. Because of its shape and expansion pressure from the spring 72, the front footing 86 will firmly engage the tram rail 51F, 52F as shown. In the case where electricity is needed by an article carried on the sliding carriage assembly, a terminal (not shown) in the footing 86 would make contact with the front power track 121F and allow power to flow to the article.

Figure 13:
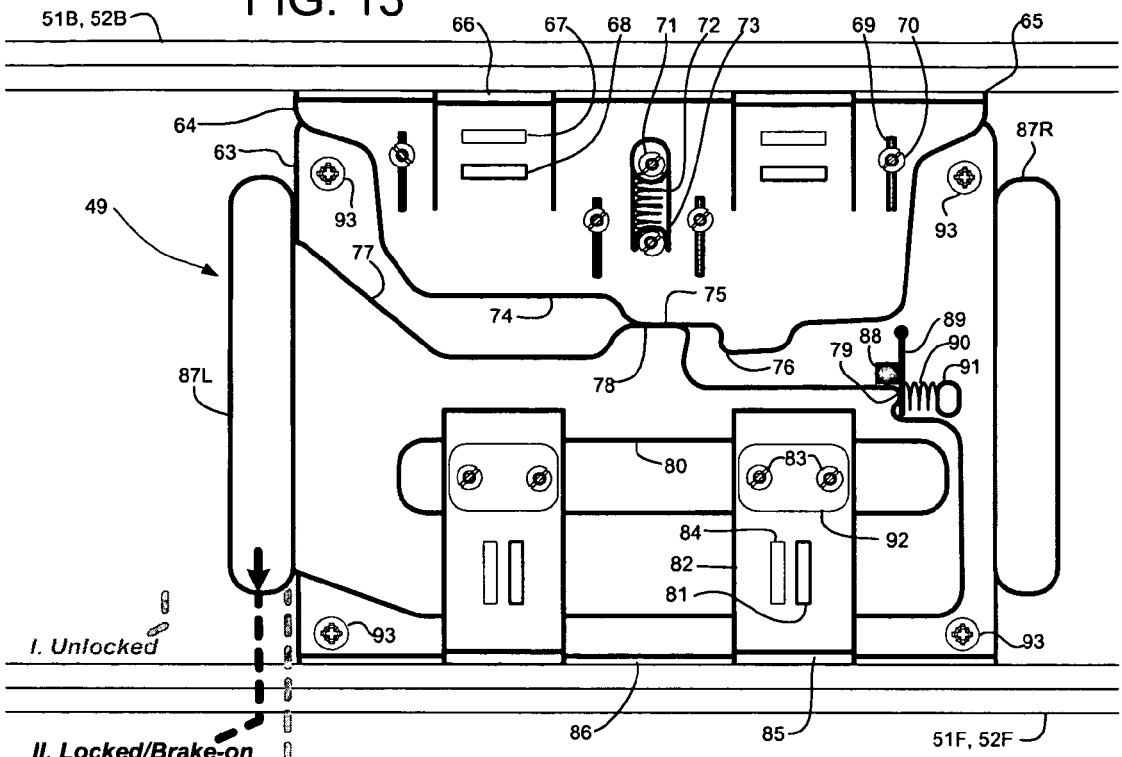
FIG. 13 is a schematic top view of the tram-engaged sliding carriage assembly with the locking handle in the "Locked/Brake-ON" position (position II).
Figure 13A:
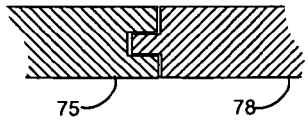
FIG. 13*a* is a side schematic view of the slotted edges of the lock plate and the engaging plate engaging each other.

FIG. 13 is a schematic top view of the tram-engaged sliding carriage assembly with the locking handle 87L in the "Locked/Brake-ON" position (position II) meaning the sliding carriage assembly is locked in the rails and cannot slide laterally. The rear engaging plate 64 is in the same position as in FIG. 10. The sliding lock cam 77 has moved such that its locking edge 78 has engaged the compression stop edge 75 on the engaging plate 64. Both of these edges 75 and 78 should be slotted (male and female) to interlock and not overlap while sliding (FIG. 13*a*). With the sliding lock cam 77 in this position the engaging plate 64 cannot be compressed and therefore the sliding carriage assembly is locked onto the tram rails 51B, 52B and cannot be taken off the rails unless the lock handle 87L is returned to position I. The brake return lever 89 keeps the locking plate in position II. Having been slid back into the "locked/brake-on" position (II), the sliding lock cam 77 has moved such that the lift bump 84 has slid in under the lock arm 82 thus raising the brake hook 85 to where it engages the tram rail 51F, 52F.

Figure 14:
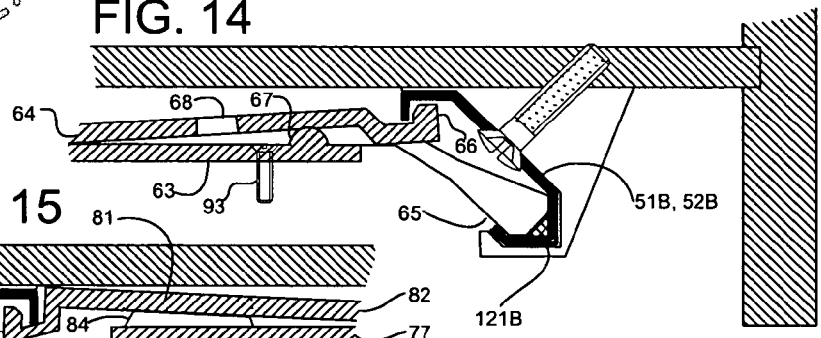
FIG. 14 is a fragmentary schematic side view of the tram-engaged sliding carriage assembly's rear tram footing in its compressed, tram-rail-engaged state (same as FIG. 10).

FIG. 14 is a fragmentary schematic side view of the tram-engaged sliding carriage assembly's rear tram footing in its compressed, tram-rail-engaged state (same as FIG. 11). The movement of the locking handle 87L has not affected the position of the rear tram footing section. It should be noted, however, that now the engaging plate 64 can no longer be moved relative to the carriage base platform 63 by applying backward pressure to the handles 87L and 87R.

Figure 15:
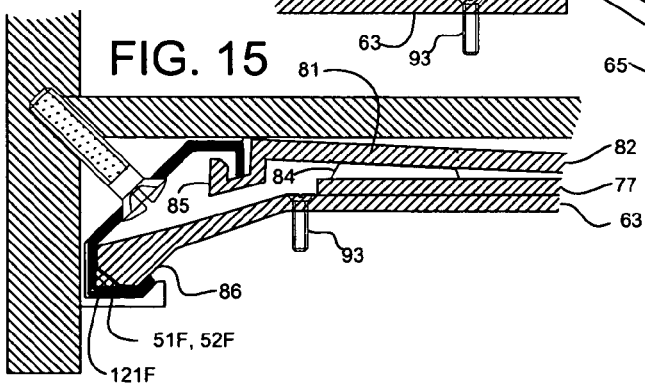
FIG. 15 is a fragmentary schematic side view of the tram-engaged sliding carriage assembly's front carriage footing and brake section with the brake arm lifted to meet the Tram-Rail.

FIG. 15 is a fragmentary schematic side view of the tram-engaged sliding carriage assembly's front carriage footing 86 and brake section with the brake arm 82 lifted and the brake hook 85 engaging the top edge of the tram-rail 51F, 52F. The sliding lock cam 77 has moved such that the brake lift bump 84 has slid in under the lock arm 82 thus raising the brake hook 85 to where it engages the tram rail 51F, 52F. Note the contact friction between the brake hook 85 and the top tram rail edge will prevent the sliding carriage assembly from moving laterally. Because of the tram footing 86 shape, the downward pressure from the break arm hook 85, the weight of the carriage and carriage payload and the expansion pressure from the spring 72, the front carriage footing 86 will firmly engage the tram rail 51, 52 as shown.

Figure 16:
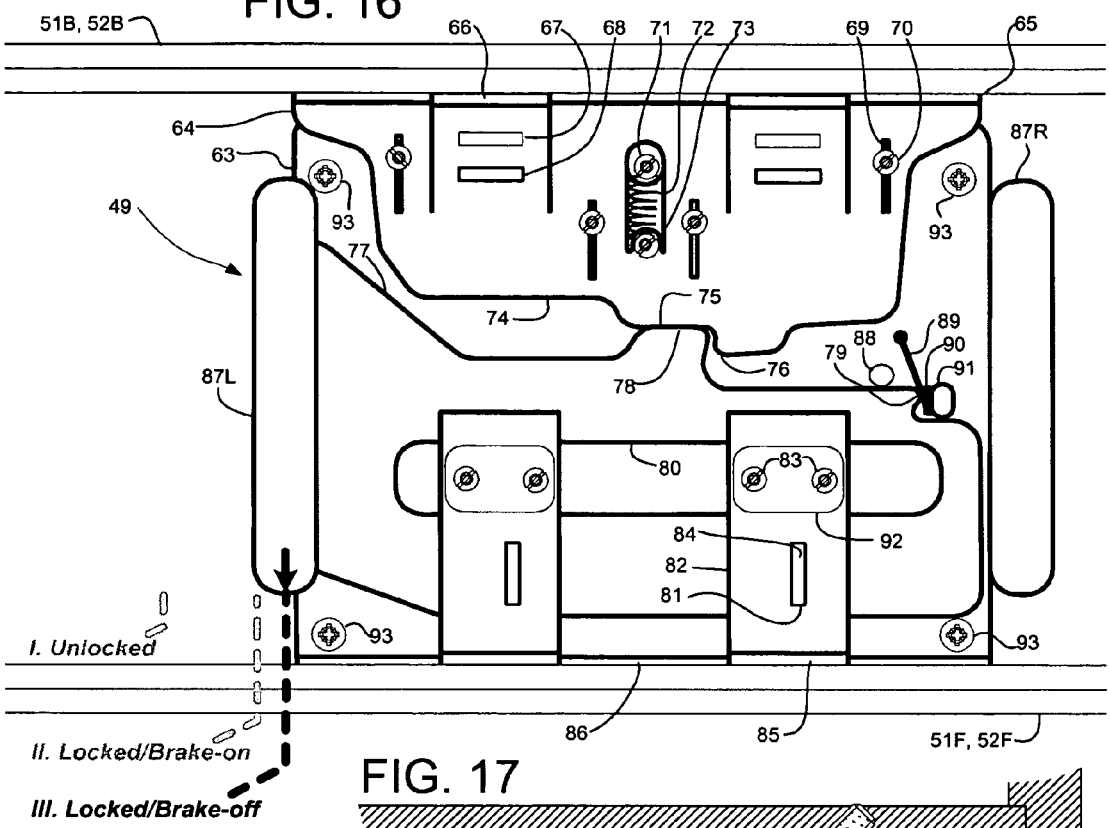
FIG. 16 is a schematic top view of the tram-engaged sliding carriage assembly with the locking handle in the "Locked/Brake-OFF" position (position III).

FIG. 16 is a schematic top view of the tram-engaged sliding carriage assembly with the locking handle 87L in the "Locked/Brake-OFF" position (position III) meaning the sliding carriage assembly is still locked on the tram rails but can slide laterally. This happens when the locking handle 87L is further compressed inward toward the carriage base platform 63. The sliding lock cam 77 will then move to the extent that the lift bump 84 will align under the cutout notch 81. As a result the brake arm will flex back to its resting position and the brake hook 85 will disengage the top edge of the tram rail 51F, 52F. This will allow the sliding carriage to slide laterally in the tram rails so long as pressure is maintained on the locking handle 87L. The brake stop 76 on the rear footing plate 64 will ensure that the lift bump 84 will align under the brake cutout notch 81 and not slide further. Once pressure is released from the locking handle 87L the compressed spring 90 anchored at spring anchor 91 will push the brake return lever 89 and hence the sliding lock cam 77 at push point 79 back to the lever stop 88 (i.e., to "Locked Brake-ON" position II).

Figure 17:
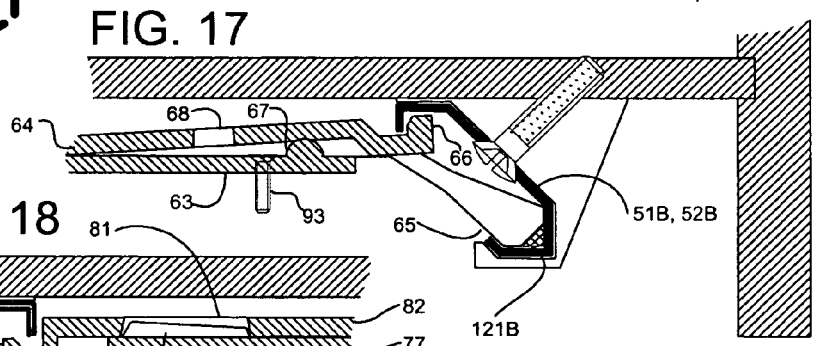
FIG. 17 is a fragmentary schematic side view of the tram-engaged sliding carriage assembly's rear tram footing section in its compressed, tram-rail-engaged state (same as FIGS. 10 & 13).

FIG. 17 is a fragmentary schematic side view of the tram-engaged sliding carriage assembly's rear tram footing section in its compressed, tram-rail-engaged state (same as FIGS. 11 & 14). The further compression of the locking handle 87L does not affect the rear footing section. The footing 65 is still locked in and still able to slide.

Figure 18:
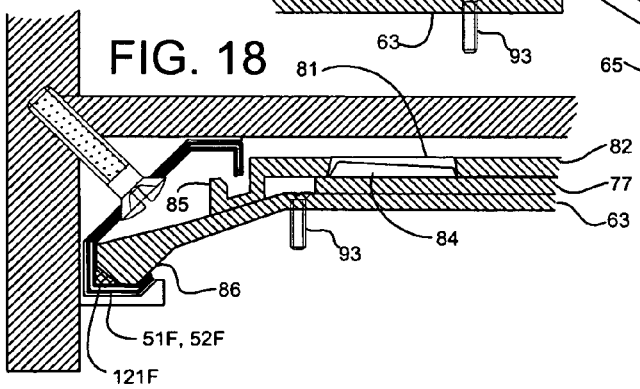
FIG. 18 is a fragmentary schematic side view of the tram-engaged sliding carriage assembly's front carriage footing and brake section with the brake arm having disengaged the Tram-Rail (same as FIG. 11).

FIG. 18 is a fragmentary schematic side view of the tram-engaged sliding carriage assembly's front carriage footing 36 and brake section with the brake hook 85 having disengaged the tram-rail (same as FIG. 12). The sliding lock cam 77 has moved to the extent that the lift bump 84 aligns under the cutout notch 81. As a result the brake arm 82 will flex back to its resting position and the brake hook 85 will disengage the top edge of the tram rail 51F, 52F. This will allow the sliding carriage to slide laterally in the tram rails so long as pressure is maintained on the locking handle 87L.

The preferred embodiment as shown allows a user to easily mount, lock in, move/slide and remove the sliding carriage 49 and its payload by hand and without the use of tools.

Sliding Carriage Assembly—Other Embodiments

[Other embodiments of the carriage footing arrangement could assume other concave or convex profile configurations depending on the rail configuration(s) to which they must engage. Other embodiments could also exclude a specific braking/brake-releasing mechanism as is included in the preferred embodiment. Other embodiments could also include other means for affecting the carriage footings to engage the tram rails. While the preferred embodiment uses a sliding cam plate arrangement to accomplish this, any number of means including a lever handle, magnetic or an electromechanical arrangement could be used. Other embodiments could also include means for locking the carriage on the tracks with a key for security/theft prevention considerations.]

Fold-Down Easel—Preferred Embodiment

Figures 19, 20, 21:
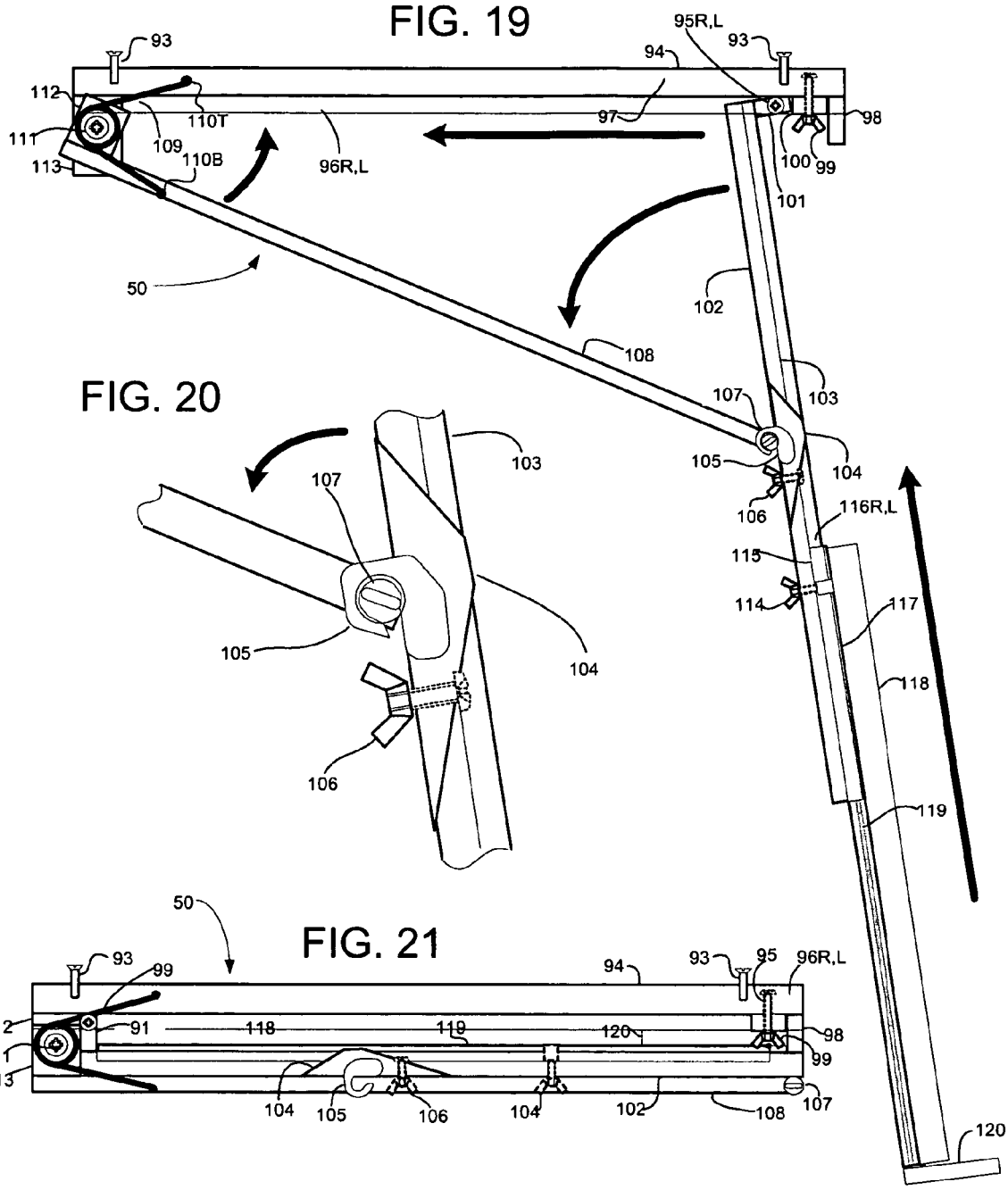
FIG. 19 is a schematic side view showing the "clamshell designed" fold-down easel in its OPEN (i.e., pulled down) position.
FIG. 20 is an enlarged, fragmentary schematic side view of the easel "twist-locking" catch.
FIG. 21 is a schematic side view showing the "clamshell designed" pull-down easel in its CLOSED (i.e., folded up) position
Figure 24:
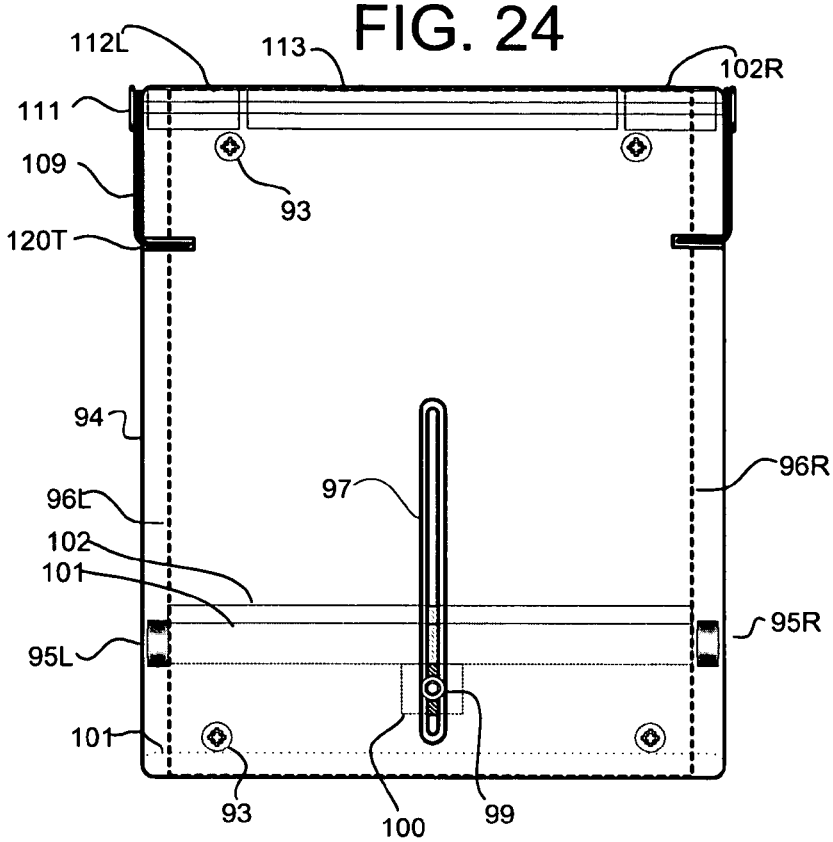
FIG. 24 is a schematic view from above showing the hanger hooks in the "open easel" position engaging the easel base.

FIG. 19 is a schematic side view showing the clamshell-configured pull-down easel 50 in its open/deployed (i.e., pulled down) position. The easel base 94 is a rectangular panel that attaches parallel to the underside of the sliding carriage assembly (shown previously in FIGS. 7-18) on the mounting post/screws 93 at its four corners. The easel shelf 102 is attached slidably to the easel base 94 by slide pins 95 R, L fixed into both sides of the easel cap 101 and slide inside the easel base 94 (see also FIG. 24) in shallow slide channels 96 R, L bent down from both right and left edges of the easel base 94. A long bolt and wing nut 99 attach a stop block 100 to the easel base 94 through a stop slot 97. This allows the position of the stop block 100 to be adjusted front to back by tightening and loosening the wing nut. The easel base skirt 98 is a thin rectangular block attached at its narrow edge to the front edge of the easel base 94. The easel shelf 102 will rest on the skirt 98 when the unit is folded (see FIG. 21).

Figure 22:
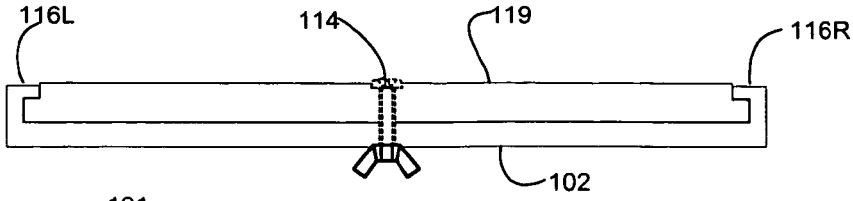
FIG. 22 is a front schematic view of the folded-up easel shelf and easel shelf extension.
Figure 23:
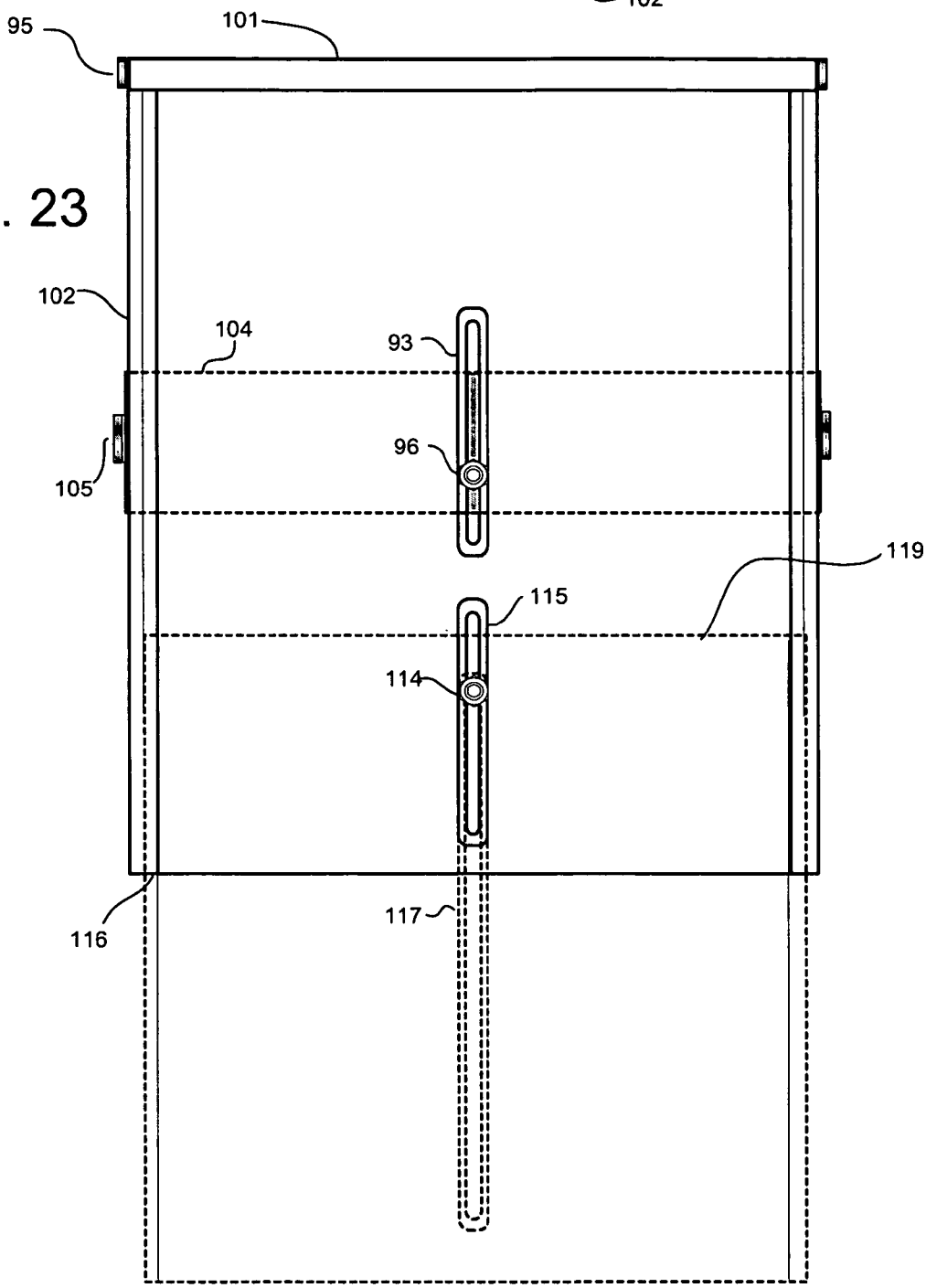
FIG. 23 is a front schematic view of the folded down easel shelf and easel shelf extension (dotted line).

The easel shelf 102 is a flat rectangular panel with a channeled guide ridge 116 on its right and left edge (see also FIGS. 22 and 23). The easel shelf extension 119 fits slidably in between the two guide ridges 116 of the easel shelf 102. The easel shelf extension 119 is kept from sliding off of the easel shelf by an adjustable stop post 114. This stop post 114 is wing-nut-adjustable in base slot 115 of the easel base. When the fold-down easel moves to its closed position (see FIG. 21) the easel shelf extension 119 will slide up within the base channel 116 R, L the length of extension slot 117 on stop post 114. An article or payload (e.g., appliance or storage unit) 118 can be fixed to the outward face of the easel shelf extension 119. A fold-down easel foot 120 can also be attached at the bottom of the easel shelf extension 119 for book holding applications and the like.

Figure 25:
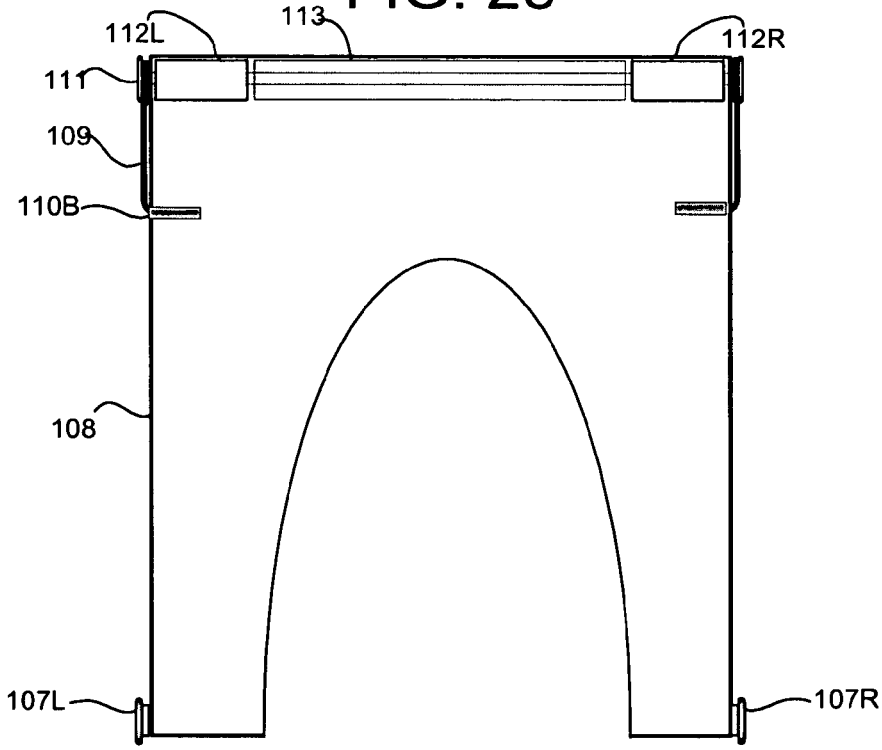
FIG. 25 is a view of the upward facing surface of the cover brace.

In its open (i.e., folded-down) position the fold-down easel's cover-brace 108, functions as an elongated bracing member that stabilizes the easel shelf 102. The back of the cover-brace 108 is anchored to the easel base 94 at the back hinge assembly which consists of three nested hinge blocks, namely side hinge blocks 112 R and L and middle hinge block 113 (see also FIGS. 24 & 25). 112 R and L are attached to top surface of the two back corners of the cover-brace 108. 113 is centered at the back of the bottom surface of the easel base 94. An axel 111 through the blocks allows the two panels 94 and 108 to hinge freely. A closed-tensioned spring 109 surrounding the axel 111 and joined to the panels at spring pressure points 110 T and B, keep the fold-down easel unit folded up when in its closed position. At the other end of the cover brace 58 a twist-locking catch post 107 engages a narrow-channel hook 105 that is secured to both sides of the easel shelf (see also FIGS. 23 and 25). Note that when the fold-down easel unit is being folded and the easel shelf 102 and cover-brace 108 become parallel to each other, the twist-locking catch post 107 will be able to disengage the narrow-channel hook 105 (see also FIGS. 20 & 21). The narrow-channel hooks 105 R and L are mounted on a hook saddle 104 that wraps around the back of the easel shelf 102 and slides up and down. It is held in place by a wing nut 106 that fits through base slot 103 (see also FIG. 23). As such, the position of the narrow-channel hooks 105 R and L can be adjusted by loosening the wing nut 106 and moving the hook saddle 104. As indicated previously, the stop block 100, narrow-channel hooks 105 R and L and stop post 114 can be adjusted by the user. These adjustments will determine the height, protrusion and tilt of the easel and its payload when pulled down into the open position. Note that it is possible for a payload 118 fixed to the easel shelf 102 or easel shelf extension 119 to be wider than these platforms themselves and not interfere in any way with the opening and closing of the unit.

Fold-Down Easel—Other Embodiments

[Rather than depending on the closed-tensioned spring 109 to hold the unit closed, other embodiments of the fold-down easel could have the cover-brace 108 and the easel shelf 102 held in their folded-up position by a friction closing catch installed on the easel base skirt 98 at the point where it meets the cover-brace 108 and/or the easel shelf 102.

The hinging means represented by the hinge blocks 112 and 113, axel 111, and closed-tensioned spring 109 could be enlarged considerably to accommodate a wider payload or made smaller to accommodate smaller payloads.

A payload could also be attached directly to the easel shelf 102 in cases where no easel shelf extension 119 is required.

The narrow-channel hook 105 could also be replaced by a long slotted channel guide attached to both sides of the easel shelf that the catch post 107 slides within. The deployed engaging point of this channel and catch post 107 could be moved with an arrangement similar to the hook saddle 104 in the preferred embodiment or simply with a moveable stop post like 114.]

CONCLUSION AND RAMIFICATIONS

Thus the reader will see that the system of the invention provides the user with a convenient means to mount, move, remove, and store articles under a downwardly facing surface such that the articles are inconspicuous or essentially hidden from view under the downwardly-facing surface, and such that pull-down access to said articles can be gained easily by a user and can be adjusted for height, tilt and depth relative to the user and adjusted laterally along the entire, continuous facing edge of the downwardly-facing surface and whereby said access and orientation adjustments and said manipulations can be executed easily by hand and without the use of tools. The system is also very easy to install requiring no planning, measuring, cutting clamping or fitting.

While my above description contains many detailed specifics, these should not be construed as limitations on the invention but rather as an example of one preferred embodiment thereof. Many other variations are possible. For example the fold-down easel could be used without the sliding carriage and tram rail in cases where the user does not foresee the need to remove or move the unit from a given location. Also practically anywhere the preferred embodiment calls for a planar member the member can be narrowed or made into latticed member to reduce weight and material use.

Accordingly the scope of the invention should be determined not by the embodiments illustrated, but by the appended legal claims and their legal equivalents.

What is claimed is:

1. A system for mounting, moving and removing articles under a downwardly facing surface having a front accessible edge oriented parallel to the surface comprising:

a pair of elongated support members forming a tram rail arrangement comprising:

one of said elongated support members being adapted for attachment on the downwardly facing surface substantially parallel with the front edge as a forward load-bearing member; and another of said elongated support members being adapted for (i) attachment on the downwardly facing surface as a rearward load-bearing member, and (ii) substantially parallel spacing apart from said one support member a distance sufficient to ensure torquing stability in a state where an engageable carriage and an attached carriage payload is engaged with, and suspended from, said load-bearing members; and an engageable moveable carriage comprising:

a carriage base platform adapted to accept a carriage payload, said base platform having a first footing dimensioned to engage one of said load-bearing members; and a substantially flat plate movably engaging said base platform and having a terminating edge comprising a second footing dimensioned and positionable to engage another of said load-bearing members;

wherein said first and second footings cooperatively engage said tram rail arrangement whereby said engageable moveable carriage and said attached carriage payload are suspended from said load-bearing members and stabilized during movement laterally to any position on said tram-rail arrangement.

2. The system of claim 1 wherein said first and second footings slideably engage said load-bearing members whereby said engageable, moveable carriage can be slid laterally to any continuous position on said tram-rail arrangement without being fully disengaged from the track.

3. The system of claim 1 wherein said means for moving said engaging plate relative to said base platform can be manipulated by hand without the need for tools.

4. The system of claim 1, further comprising a pull-down easel comprising:

a substantially flat, horizontal, rigid easel base having an upper surface, a rearward portion and an underside and attachable to said tram rail arrangement;

an elongated bracing member having a rearward portion and an end;

means for hingedly connecting the rearward portion of said elongated bracing member to the rearward portion of said easel base, said hinged connection means dimensioned to accommodate the thickness of an easel payload;

an easel shelf having a back edge adapted to support the easel payload, said easel shelf slidably attached at or near its back edge to the underside of said easel base, means for engaging the end of said elongated bracing member with said easel shelf at a point on said easel self whereby said easel shelf is deployed and supported obliquely in a position whereby the easel payload is accessible to a user; and means for securing said elongated bracing member and said easel shelf in a stored, folded up position parallel to said base;

whereby when folded down, a substantially triangularly braced easel arrangement is formed with said easel extending downward relative to the downwardly facing surface and when folded up a flat comparatively compact unit is formed.

5. The system of claim 4, further comprising means for attaching the upper surface of said easel base to the underside of said base platform of said sliding carriage whereby said easel forms the carriage payload;

whereby the system enables a user to mount, move, remove, and store articles such that the articles are inconspicuous or essentially hidden from view under the downwardly-facing surface, and such that access orientation to said articles can be gained easily by a user and can be adjusted for height, tilt and depth relative to the user and laterally along the front accessible edge of the downwardly-facing surface and whereby said access orientation adjustments and said manipulations can be executed by hand and without the use of tools.

6. The system of claim 5, wherein said easel base of said pull-down easel and said base platform of said sliding carriage are integrally formed as one substantially rigid, planar member.

7. The system of claim 4, where said hinged connection means comprises:

an axle and a spring; and an upper and a lower hinge block connected to said rearward portion of said elongated bracing member and said rearward portion of said easel base;

wherein said axle extending through said hinge blocks and said spring, with said spring biasing said elongated bracing member upward toward said easel base to maintain the easel in a folded-up position without the aid of a catch closing device.

8. The system of claim 4, further comprising a moveable stop post slidably attached to the underside of said easel base and wherein said easel shelf is slidably attached at or near its back edge to the underside of said easel base, whereby said stop post can be moved to limit the forward movement of said easel shelf and therefore provide means for adjusting the tilt and forward position of said easel shelf.

9. The system of claim 4, where the means for engaging the end of said elongated support member with said easel shelf at a point on said easel shelf whereby said easel shelf is deployed, comprises two narrow-channel hooks downward facing on said easel shelf and two catch posts protruding perpendicularly from the end of said elongated support member, said narrow-channel hooks being slidably attached and adjustable whereby movement of said narrow-channel hooks provides means to adjust the tilt and forward position of said easel shelf.

10. The system of claim 1, wherein the forward load-bearing member and the rearward load-bearing member each comprise two nesting, slidably engageable, substantially concave, c-shaped-profile, elongated sections whereby said nested elongated sections expand and contract longitudally.

11. The system of claim 1, further comprising a perpendicular bracing member and attaching means, wherein said forward load-bearing member and said rearward load-bearing member are maintained parallel to each other by a perpendicular bracing member with said attaching means connecting said load-bearing members with said perpendicular bracing and providing a further attachment point with respect to the downwardly facing surface.

12. The system of claim 1, further comprising a conductive strip, wherein at least one of said load-bearing members carrying on their length the conductive strip, wherein the corresponding footing being operatively engaged to said conductive strip when said sliding carriage is mounted on said tram rails whereby electrical power can be delivered to a carriage payload requiring electricity.

13. The system of claim 1, wherein a lock cam is slidably attached to said carriage base platform such that it can be moved to shift said engaging plate to engage said carriage footings with said load bearing members.

14. The system of claim 13, wherein said lock cam can be moved to frictionally engage one of said carriage footings and said tram-rail arrangement to lock said sliding carriage in place.

* * * * *